United States Patent [19]

Nyssen et al.

[11] 4,030,330

[45] June 21, 1977

[54] MULTIPLE ROLL RECORRUGATOR

[75] Inventors: Adrianus Marinus Nyssen, Chilliwack; Gerhard Josef Rauch, Surrey, both of Canada

[73] Assignee: Ironside's Machine & Welding Ltd., Chilliwack, Canada

[22] Filed: Aug. 20, 1976

[21] Appl. No.: 716,166

Related U.S. Application Data

[63] Continuation-in-part of Ser. No. 621,398, Oct. 10, 1975, abandoned.

[52] U.S. Cl. ..... 72/105; 72/107; 72/179; 72/465

[51] Int. Cl.[2] ..... B21D 19/04

[58] Field of Search ..... 72/105, 106, 107, 108, 72/109, 110, 179, 465; 29/125, 130

[56] References Cited

UNITED STATES PATENTS

| | | | |
|---|---|---|---|
| 837,756 | 12/1906 | Thomas | 29/125 |
| 2,170,946 | 8/1939 | Grief | 72/106 |
| 2,292,851 | 8/1942 | Tykal | 29/125 |
| 2,326,076 | 8/1943 | Solem | 29/125 |
| 3,464,253 | 9/1969 | Beyer et al. | 72/110 |
| 3,485,076 | 12/1969 | Colburn | 72/465 |

FOREIGN PATENTS OR APPLICATIONS

| | | | |
|---|---|---|---|
| 1,184,726 | 1/1965 | Germany | 72/179 |

*Primary Examiner*—Lowell A. Larson
*Attorney, Agent, or Firm*—Lee & Smith

[57] ABSTRACT

The invention concerns an apparatus for forming annular circumferential corrugations in the end of a helically corrugated seamed pipe. Two corrugating rolls, a backup roll and a thrust roll, engage the wall of the pipe to form the annular corrugations. The backup roll normally engages the inner wall of the pipe, and the thrust roll, the outer wall. The thrust roll is formed from a plurality of independent and transversely movable roll sections urged with a predetermined force into engagement with the pipe by a support composed of a group of rolls engaging the periphery of a corresponding roll section and mounted within a pivotable lever frame. The predetermined force is provided by a pressure-controlled hydraulic cylinder acting through each of the lever frames.

17 Claims, 6 Drawing Figures

MULTIPLE ROLL RECORRUGATOR

BACKGROUND OF THE INVENTION

This application is a continuation-in-part of U.S. patent application Ser. No. 621,398, filed Oct. 10, 1975, now abandoned.

This invention relates to an apparatus for forming annular or circular circumferential corrugations in the end of a helically corrugated seamed pipe, and more particularly to an apparatus for forming such circumferential corrugations in the end of a helically corrugated lock seam pipe.

Corrugated pipe, such as that utilized in drainage culverts and the like, is generally formed in two basic configurations. The first is corrugated pipe in which the corrugations are formed as annular circumferential grooves in the wall of the pipe, the pipe being formed from an elongated sheet which is first impressed with the corrugations and the longitudinal ends of the elongated sheet then folded about to contact each other and welded or riveted to form the pipe. Since the grooves in this type of pipe are circumferential, sections of pipe can be joined together with a simple metal sealing band which can be force-fitted to the outermost annular corrugations of each of the ends of the abutting pipes.

The second basic type of corrugated pipe, with which the present invention is concerned, is that in which the corrugations are helically impressed in the pipe walls. This type of pipe is normally formed by bending an elongated sheet of metal, containing longitudinal corrugations therein, into helical convolutions and securing the adjacent edges of the convolutions to form a seam. As the fabricated pipe emerges from the pipe apparatus, it is cut into desired lengths. However, since the pipe is formed with helical corrugations, the normal sealing band utilized with circumferentially corrugated pipe cannot be used to join two pipe ends together. As a result, the helically corrugated pipes are often "recorrugated" at their ends to form annular circumferential grooves which are adapted to utilize a normal sealing band.

The prior art recorrugating apparatus, as evidenced by U.S. Pat. Nos. 3,548,623 and 3,662,579, is customarily constructed of one or more roll sections which are immobily affixed to a rotatable shaft to form a corrugating roll, with two of such rolls being utilized. One of the rolls extends within the end portion of the pipe and engages the inner wall thereof, and the other roll presses on the outer wall of the pipe in complementary mating relationship with the first roll with the pipe wall therebetween, in order to form the circumferential corrugations in the wall of the pipe. Normally, one of the rolls is passive, that is, its support axis is maintained in a fixed position, while the other roll is active in the sense that it is moved into engagement with the pipe wall between the two rolls during the corrugating operation.

In a recorrugating apparatus for helically corrugated pipe in which one roll is brought into contact with the pipe wall and the other roll is supported by means of a pressure-controlled hydraulic cylinder, it has been found that each time the opposing rolls engage an area of abnormal thickness in the pipe, such as the folded-over seam, which is oridinarily four times the pipe thickness, the depth of this area of abnormal thickness will separate the rolls to a greater extent than when the single pipe wall thickness is between the rolls. As a result, a portion of the pipe will not be fully recorrugated. The normal recorrugating apparatus produces a plurality of parallel circumferential corrugations in each end portion of the pipe, caused by a series of alternate lands and grooves formed on each of the complementary forming rolls. Since the lock seam is helically formed in the pipe, it has been found that each time one of the lands or ridges of one of the recorrugating rolls rides upon the seam in the pipe, the forming rolls will separate further due to the increased thickness of the seam. This halts full recorrugation of the pipe until the seam has been passed by the last ridge of the rolls. Therefore, when using a pair of recorrugating rolls having several mating lands and grooves, a substantial portion of the pipe is not fully recorrugated with the prior art apparatus.

THE INVENTION

The present invention overcomes the above-delineated problems of the prior art by providing a thrust roll for a corrugating apparatus including a drive shaft and a plurality of independent, transversely movable roll elements mounted about the drive shaft, each of the roll elements having an axial bore of a diameter greater than the diameter of the drive shaft. A drive means is fixedly attached to the drive shaft adjacent the plurality of roll elements and is interconnected with the plurality of roll elements for rotation of the roll elements in unison with the drive means and the drive shaft.

Preferably, the drive means includes at least one drive element attached to the drive shaft adjacent one end of the plurality of roll elements. A coupling means extends between the drive elements and the roll elements to interconnect the same. The coupling means is mounted in one of the elements and extends laterally into an aperture in each of the other elements, the aperture being larger than the extension of the coupling means extending therein in order to allow independent, transverse motion of each of the roll elements. Normally, one such drive element is attached to the drive shaft adjacent each end of the plurality of roll elements.

In a first embodiment of the invention, the multi-element thrust roll includes at least four roll elements. A drive element is fixedly attached to the drive shaft adjacent each end of the plurality of roll elements, and the drive elements rotate in unison with the drive shaft as it is driven. A coupling means, comprising a pair of driving pins, is mounted in the roll element adjacent each drive element, with each of the driving pins having extensions protruding from the roll element laterally into accommodating apertures both in the drive element and in the next adjacent roll element. In this manner, each of the drive elements is directly coupled to two adjacent roll elements.

In a second embodiment of the invention, the multi-element thrust roll includes three such roll elements. A drive element is fixedly attached to the drive shaft adjacent each end of the three roll elements, and the drive elements rotate in unison with the drive shaft as it is driven. To rotate one of the three roll elements, a coupling means, comprising a pair of driving pins, is mounted in one of the drive elements. Each of the driving pins has extensions protruding from the drive element laterally into accommodating apertures in the adjacent roll element to effect a coupling between the drive element and adjacent roll element. To rotate the remaining two roll elements, a coupling means identical to that of the first embodiment of the invention is employed, mounted in the roll element adjacent the second drive element.

In either embodiment, an apparatus according to the invention comprises the multi-element thrust roll in combination with a backup roll whose axis is parallel to the axis of the drive shaft. The peripheral surface of the backup roll is formed with alternate annular lands and grooves which oppose the composite surface of the thrust roll in a complementary fashion. The backup roll and the thrust roll are engageable with the wall of the end portion of a pipe therebetween. Each of the roll elements is provided with an individual support to maintain the element in contact with the end portion of the pipe so that a series of adjacent annular circumferential corrugations is formed in the pipe as it is rotated between the thrust and backup rolls.

Preferably, each of the individual supports urges each roll element into contact with the pipe with a predetermined force provided by a hydraulic device which bears against the individual support. When an area of abnormal thickness enters between the backup roll and one of the roll elements, the roll element will be forced downward with its support, compressing the hydraulic device, thereby displacing the roll element and increasing the distance between the roll element and backup roll until such time as the area of unusual thickness, such as a lock seam, has been passed. However, adjacent roll elements, which are in engagement with the normal thickness of the pipe, will continue to perform their corrugating function until each, in turn, engages and is displaced by the seam.

Each of the individual supports comprises a group of small support rolls which engage the periphery of each of the roll elements, with the support rolls being mounted for rotation at spaced positions about the periphery of the roll element within a lever frame. The lever frame is attached to a fixed pivot on one end, and the other end is supported by the hydraulic device. In this manner, each of the roll elements is independently supported for individual transverse movement about the drive shaft.

By reason of the various features of the invention as described in detail hereinafter, a multiple roll recorrugating apparatus according to the invention is provided which fully recorrugates substantially all portions of the end of the pipe, including those areas adjacent an area of abnormal thickness.

BRIEF DESCRIPTION OF THE DRAWINGS

The invention is illustrated in the following drawings in which.

DETAILED DESCRIPTION OF THE INVENTION

The Embodiment of FIGS. 1–4

Figure 2:
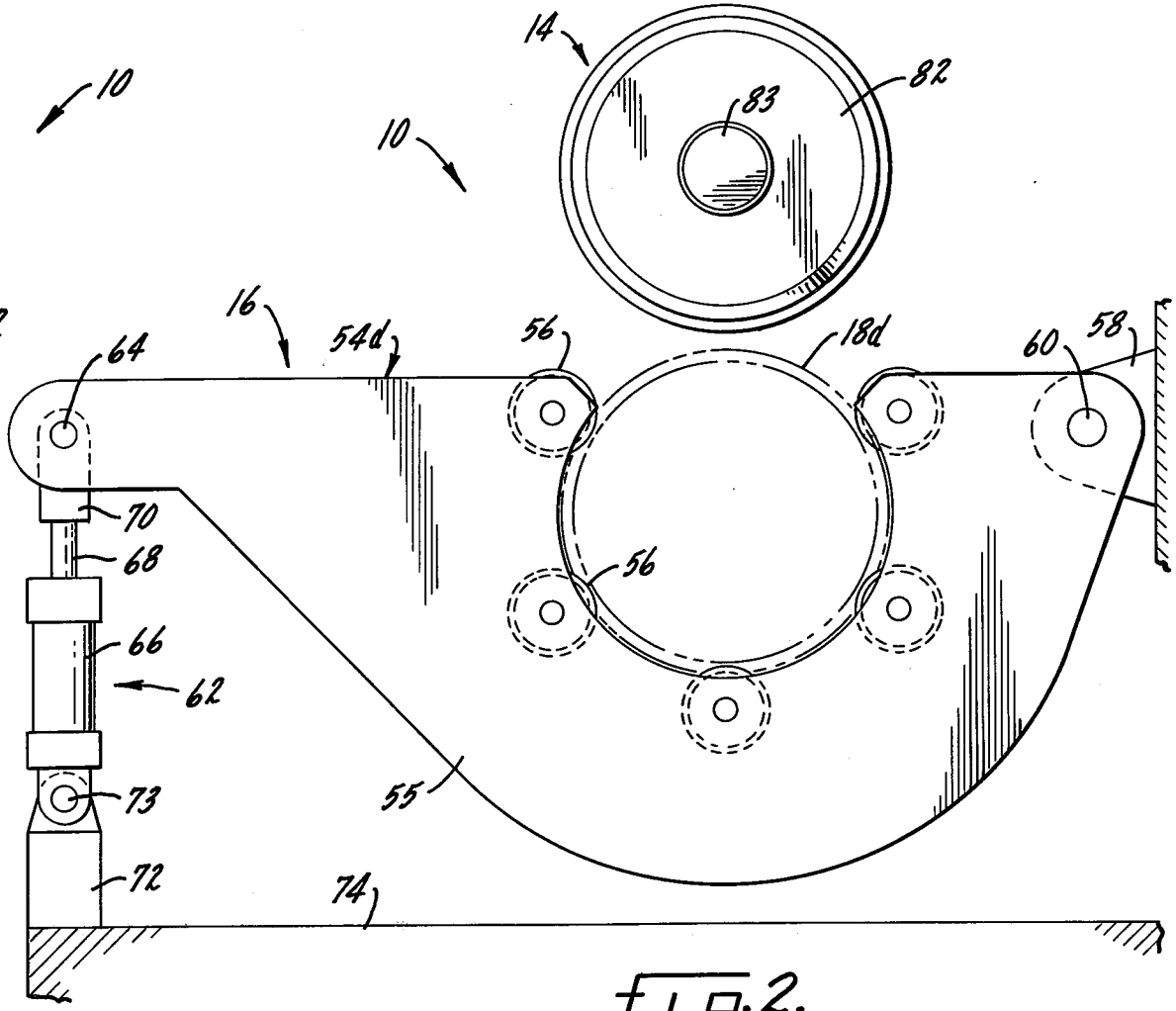
FIG. 2 is a sectional view taken along lines 2—2 of FIG. 1, illustrating one of the lever frames.

The recorrugator apparatus according to the invention is generally depicted by the reference numeral 10 and comprises a composite thrust roll 12, a backup roll 14, and a support assembly 16.

The thrust roll 12 includes a plurality of roll elements 18*a*, 18*b*, 18*c* and 18*d* carried by a drive shaft 20. One end of the drive shaft 20 extends from a suitable prime mover 22 utilized to rotate the drive shaft 20. The other end of the drive shaft 20 is rotatably mounted within an antifriction bearing assembly 24 contained within a bearing support 26 which forms part of the stationary frame of the recorrugator 10. Each of the roll elements 18*a* through *d* is independently and individually shiftably mounted on the drive shaft 20. An inner diameter 28 of each of the roll elements 18*a* through *d* is larger than the diameter of the drive shaft 20 passing therethrough, creating a normally annular space 30 which permits individual transverse movement of each of the roll elements 18*a* through *d* with respect to the drive shaft 20.

A thrust roll drive mechanism of the recorrugator apparatus 10 is generally designated by the reference numeral 31. The drive mechanism is composed of a first drive plate 32 attached to an enlarged diameter end portion of the shaft 20 formed adjacent one end of the composite thrust roll 12 and a second drive plate 34 attached to the shaft 20 adjacent the opposite end portion of the thrust roll 12. Each of the drive plates 32 and 34 is secured for rotation with the drive shaft 20 by respective keys 36 and 38 which are drivingly engaged in keyways formed in the respective end portions of the shaft and in opposed portions of the respective drive plates 32 and 34. To drivingly interconnect the drive plate 32 of the drive mechanism 31 and the roll elements 18 *a* and *b* of the composite thrust roll 12, a pair of coupling means 40, diametrically opposed as illustrated, is provided. Similarly, to drivingly interconnect the drive plate 34 of the drive mechanism 31 and the pair of roll elements 18*c* and *d* of the composite roll 12, a pair of diametrically opposed coupling means 41 is provided. As the coupling means 40 and 41 are substantially identical, only the coupling means 40 will be described in detail.

Each of the coupling means 40 comprises a driving pin 42 mounted within an aperture 43 formed in the roll element 18*a* which is adjacent the drive plate 32. A pair of antifriction bearings 44 have their inner races secured in an axially spaced relation about the central portion of the drive pin 42 and their outer races secured in enlarged portions of the aperture 43 to accommodate rotation of the driving pin 42 within the roll element 18*a*. The driving pin 42 includes an integral axial extension 46 at one end which protrudes into an aligned circular aperture 48 in the adjacent roll element 18*b*, and an integral axial extension 50 at the other end which extends into an aligned circular aperture 52 formed in the first drive plate 32. Each of the apertures 48 and 52 is significantly larger in diameter than the respective extensions of the driving pin 42 extending therein, thus allowing transverse movement of the roll element 18*a* relative to the drive plate 32 and allowing transverse movement of the roll element 18*b* relative to the roll element 18*a*. The construction and arrangement is such that the coupling means 40 connect the roll elements 18*a* and 18*b* for positive rotational drive by the drive plate 32 of the drive mechanism 31, and at the same time both of the roll elements are provided with the capacity for individual transverse shifting relative to the drive shaft 20 and the drive plate 32.

The coupling means 41, the roll elements 18*c* and *d*, and the drive plate 34 are drivingly interconnected and transversely shiftably arranged in the same manner as described in connection with the coupling means 40, the roll elements 18*a* and *b*, and the drive plate 32.

To assemble the composite thrust roll 12, the first drive plate 32 and key 36 are secured on the drive shaft 20, with the drive plate 32 abutting against an annular shoulder 20*a* of the shaft 20. Next, the roll element 18*a* with its pair of coupling means 40 is placed on the drive shaft 20 with the extensions 50 of the driving pins 42 protruding laterally into their respective apertures 52 in the drive plate 32. The roll element 18*b* is then inserted on the shaft 20 with the extensions 46 of the driving pins 42 extending into their respective apertures 48 therein. The roll element 18*c* is then inserted on the shaft followed by the roll element 18*d* carrying its pair of coupling means 41. Next, the drive plate 34 is assembled on and affixed to the drive shaft 20 by its key 38, securing the roll elements 18*a* through *d* on the shaft 20 between the drive plates 32 and 34. Then, a spacer 49 is inserted on the shaft 20 abutting an annular shoulder 20*b* thereof, and the antifriction bearing assembly 24 is journaled on the shaft 20, with its inner race being held against the spacer 49 by an end cap 51. Finally, a bolt 53 is threadedly secured at the end of the shaft 20, with its head bearing against a lock washer to clamp the spacer 49 against the shoulder 20*b* through the end cap 51 and the inner race of the bearing assembly 24. Th dimensions of the various parts are such that a working clearance is provided, as shown, to permit individual transverse shifting of the roll elements 18*a* through *d* as described.

Figure 1:
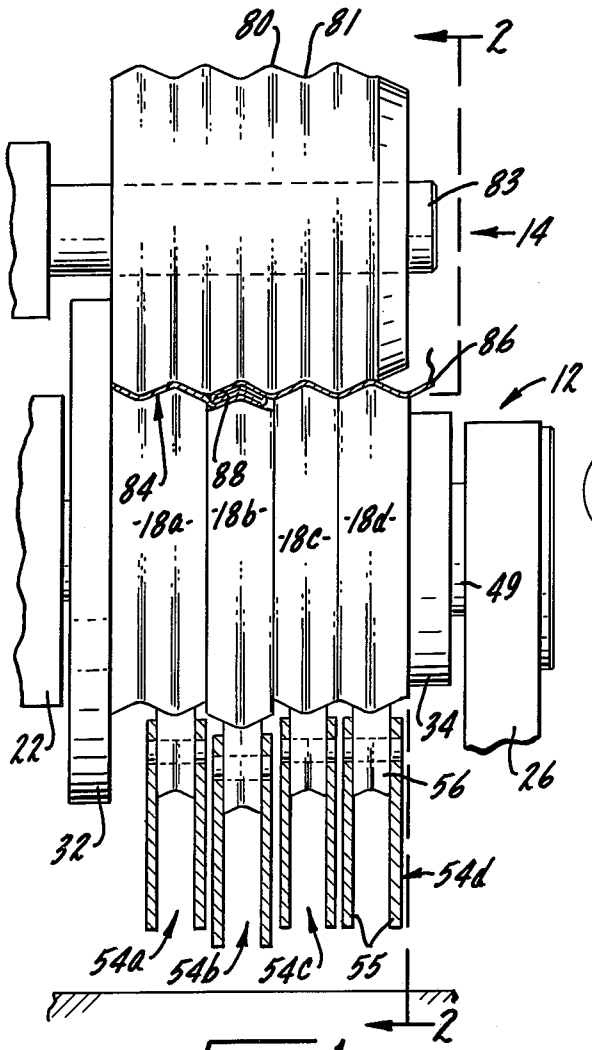
FIG. 1 is a front elevational view of the apparatus according to the invention, with the lever frames shown in section to illustrate the independency of the roll elements of the thrust roll, and with the end portion of a pipe being recorrugated by the present invention, illustrating the displacement of a roll element as the pipe lock seam is passed.

As illustrated in FIGS. 1 and 2, each of the roll elements 18*a* through *d* is supported by means of the support assembly 16. The support assembly includes an individual lever frame 54*a*, 54*b*, 54*c* and 54*d* for each of the respective roll elements 18*a*, 18*b*, 18*c* and 18*d*. As the lever frames 54*a* through *d* are substantially identical, only the lever frame 54*d* illustrated in FIG. 2 will be described in detail.

The lever frame 54*d* includes a pair of identical metal plate members 55 which are spaced from one another in sandwich fashion. Between the two plate members, five support rolls 56 are rotatably secured in such a manner that the rolls engage the periphery of the roll element 18*d* at spaced positions, so that the roll element 18*d* is rotatably supported and retained by the rolls 56. One end of the lever frame 54*d* is pivotably attached to a support member 58, which forms part of the stationary frame of the recorrugator 10, by a pin 60, while the other end of the lever frame 54*d* is pivotably attached to a hydraulic device 62 by means of a pin 64.

The hydraulic device 62 is composed of a hydraulic cylinder 66 with a piston rod 68 extending therefrom. The piston rod 68 is engaged within a pivot attachment member 70 which is pivotably secured within the lever frame 54*d* by the pin 64. The hydraulic cylinder 66 is also pivotably attached to a stanchion 72 by a pin 73, while the stanchion is mounted on a base support 74 forming part of the stationary frame of the recorrugator 10.

The hydraulic cylinder 66 is of a conventional design. The piston rod 68 extends from a piston (not illustrated) disposed within the hydraulic device and movable upwards within the hydraulic cylinder 66 to a stop (not shown), marking the maximum allowable outward extension of the piston rod 68 from the cylinder, and consequently the maximum upward travel of the lever frame 54*d*. Ideally, the maximum allowable outward extension of the piston rod is on the order of one inch. A source of hydraulic fluid (not illustrated) preferably from a conventional hydraulic fluid accumulator, is supplied under pressure to the to the hydraulic device 62 in order to maintain a predetermined and adjustable hydraulic pressure within the hydraulic cylinder 66 and to exert a predetermined force through the piston rod 68 to resist downward movement of the lever frame 54*d*. The hydraulic cylinder for each of the remaining lever frames 54*a* through *c* is also connected to the same hydraulic fluid accumulator as the cylinder 66 so that an identical pressure is exerted within all hydraulic cylinders. In this manner, downward movement of each of the lever frames 54*a* through *d* is resisted by exactly the same force. When no hydraulic fluid pressure is communicated to the hydraulic cylinders supporting each of the lever frames 54*a* through *d*, the piston rod 68 would inwardly extend a maximum distance within the cylinder 66, as would each piston rod for each hydraulic cylinder, disposing the lever frames 54*a* through *d* at their lower-most vertical positions.

Figure 3:
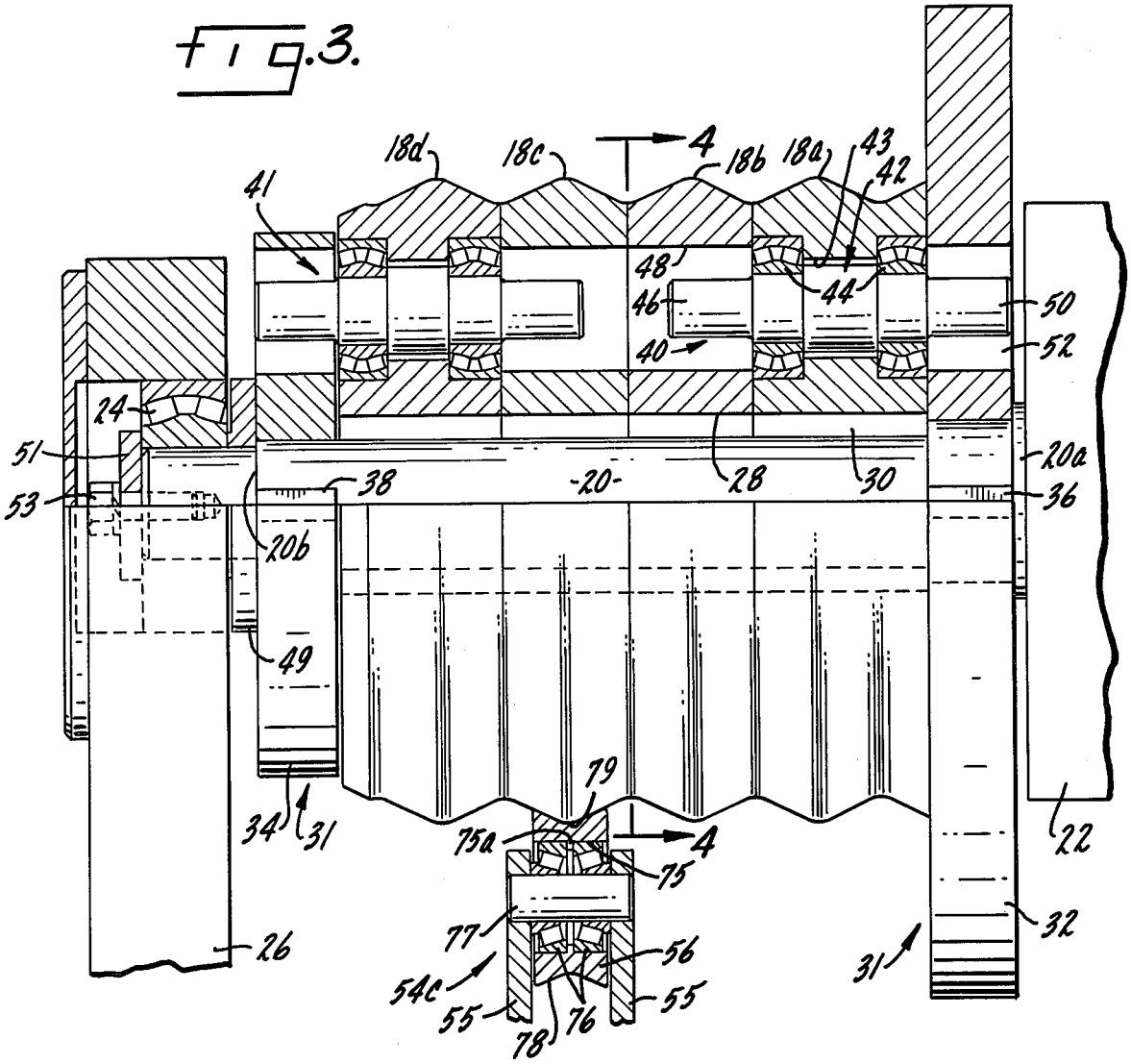
FIG. 3 is an enlarged partially sectional view of the apparatus of FIG. 1, illustrating the means to interconnect the roll elements and mount them on the drive shaft.
Figure 4:
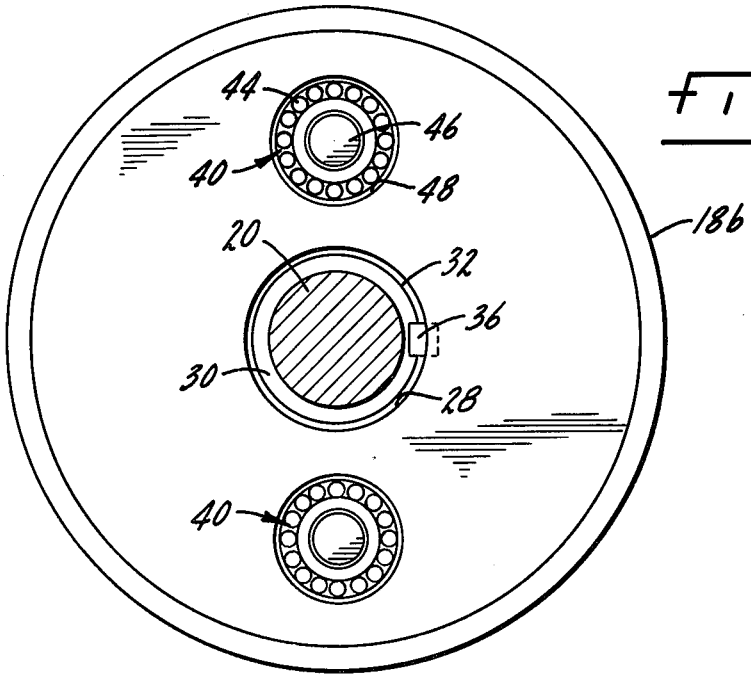
FIG. 4 is a sectional view taken along line 4—4 of FIG. 3.

Each support roll 56, as illustrated in FIG. 3, has a central aperture 75. A pair of antifriction bearing assemblies 76 are secured with their outer races within the aperture 75 separated by a circular flange 75*a*. Their inner races are mounted on a shaft 77 which is secured within the sandwiched plates 55 of the lever frame 54 as illustrated. The outer periphery 78 of the support roll 56 is generally V-shaped as illustrated in order to matingly engage a corresponding ridge 79 of the roll element 18*a* through *d* it engages. The plurality of support rolls 56 spaced about the periphery of each of the roll elements 18*a* through *d* therefore securely mount the roll elements for rotation within their respective lever frames 54*a* through *d*, precluding longitudinal movement of the roll elements along the axis of the shaft 20.

Preferably, the backup roll 14 is mounted on a shaft 83 which is transversely immobile. However, if desired for added clearance between the thrust roll 12 and the backup roll 14, the backup roll can be transversely movable with respect to its axis by an appropriate standard mechanism (not illustrated). The backup roll 14 comprises a series of ridges 80 and valleys 81 alternately formed in a cylinder 82. The ridges 80 and valleys 81 are spaced in the cylinder 82 such that when the wall of a pipe is inserted between the thrust roll 12 and the backup roll 14, and the rolls brought into engagement with the wall of the pipe, the ridges 80 and valleys 81 provide mating engagement with complementary valleys and ridges of the thrust roll 12. The cylinder 82, which may be constructed of any suitable material, is fixedly attached to the rotatable shaft 83. The shaft 83 in turn is driven by a suitable motor (not illustrated). Preferably, the shaft 83 and the shaft 20 are driven by the same prime mover 22.

The normally annular space 30 is sufficiently large so that if pressure were applied by the hydraulic fluid accumulator to the four hydraulic cylinders supporting their respective lever frames 54*a* through *d* and if no end portion of a pipe were inserted between the backup roll 14 and the thrust roll 12, the lever frames 54*a* through *d* would rise until the ridges of the roll elements engage the valleys of the transversely immobile backup roll 14, and conversely the ridges of the backup roll engage the valleys of the roll elements. If no backup roll were present, the roll elements 18*a* through *d* would rise until the pistons of the four hydraulic cylinders engage their stops. However, with the end portion of a pipe inserted between the thrust roll 12 and the backup roll 14, the roll elements 18*a* through *d* within their respective lever frames 54*a* through *d* rise until their uppermost ridges engage the wall of the pipe. Increasing the pressure of the accumulator will then cause the roll elements 18*a* through *d* to begin to deform the wall of the pipe until the wall is matingly sandwiched between the ridges and valleys of the rolls 12 and 14. The longitudinal cross section of the pipe at this position would then appear in an undulating serpentine fashion. Normally, the process of building pressure in the hydraulic cylinders is continuous and rapid until a predetermined pressure has been attained.

The operation of the apparatus is as follows:

Initially, with no hydraulic pressure communicated to the four hydraulic cylinders supporting their respective lever frames 54*a* through *d*, the piston rods attached to each lever frame are inwardly extended a maximum distance within their respective cylinders. The lever frames, and therefore the roll elements 18*a* through *d*, are disposed at their lowermost positions at this time, creating a maximum separation between the stationary backup roll 14 and the thrust roll 12. If necessary, as mentioned above, this separation can be increased by mounting the backup roll for transverse movement with respect to the thrust roll, although normally this will not be necessary.

With the roll elements 18*a* through *d* at their lowermost positions, the end portion 84 of a pipe 86 is inserted between the backup roll 14 and the thrust roll 12, abutting the first drive plate 32. Hydraulic fluid pressure is then supplied to the four hydraulic cylinders from the accumulator, causing the lever frames 54*a* through *d* and roll elements 18*a* through *d* to rise until the end portion 84 is matingly engaged between the thrust roll 12 and the backup roll 14. The hydraulic fluid pressure in the accumulator is raised sufficiently for the wall of the pipe 86 to be deformed between the rolls 12 and 14 to the serpentine longitudinal cross-sectional configuration previously described. Since different wall thicknesses and material compositions of the various pipe ends to be corrugated will require varying ultimate pressures in the accumulator to effect deformation of the pipe wall, according to known principles, the fluid pressure must be proportionately adjusted for each different pipe.

When the ultimate fluid pressure within the accumulator and four hydraulic cylinders is reached, the prime mover 22 is then energized, rotating the wall of the end portion 84 between the rolls 12 and 14 and impressing annular circumferential corrugations in the pipe wall. As the lock seam 88 of the pipe 86, normally four pipe wall thicknesses in depth, enters the space between the thrust and backup rolls, the corrugating force exerted by each of the four hydraulic devices maintains a corrugating relationship of the pipe wall between the particular roll element 18*a* through *d*, which engages the lock seam, and the backup roll 14. However, the increased thickness causes the particular roll element 18*a* through *d* to be downwardly displaced with its respective lever frame 54*a* through *d*, at the same time causing the piston and piston rod to be compressed within the hydraulic device supporting the particular lever frame. The hydraulic fluid displaced from the hydraulic device is absorbed by the accumulator with little or no increase of pressure, therefore preventing the pressure in the remaining three hydraulic devices to be raised appreciably and thus maintaining a substantially constant and equal pressure within all four hydraulic devices. As soon as the lock seam 88 has been traversed by the particular roll element 18*a* through *d*, the hydraulic pressure within the hydraulic device attached to the particular depressed lever frame 54*a* through *d* causes the lever frame and particular roll element 18*a* through *d* to rise and again corrugate the now single thickness of the wall of the end portion 84.

This same process occurs as the lock seam traverses each adjacent roll element 18*a* through *d*, thereby preventing termination of full corrugation of the pipe in that period during which the individual roll elements 18*a* through *d* are in contact with the lock seam 88 of the pipe. At all times, all roll elements 18*a* through *d* not in contact with the lock seam 88 are in constant full corrugating contact with the normal wall thickness of the end portion of the pipe.

Figure 5:
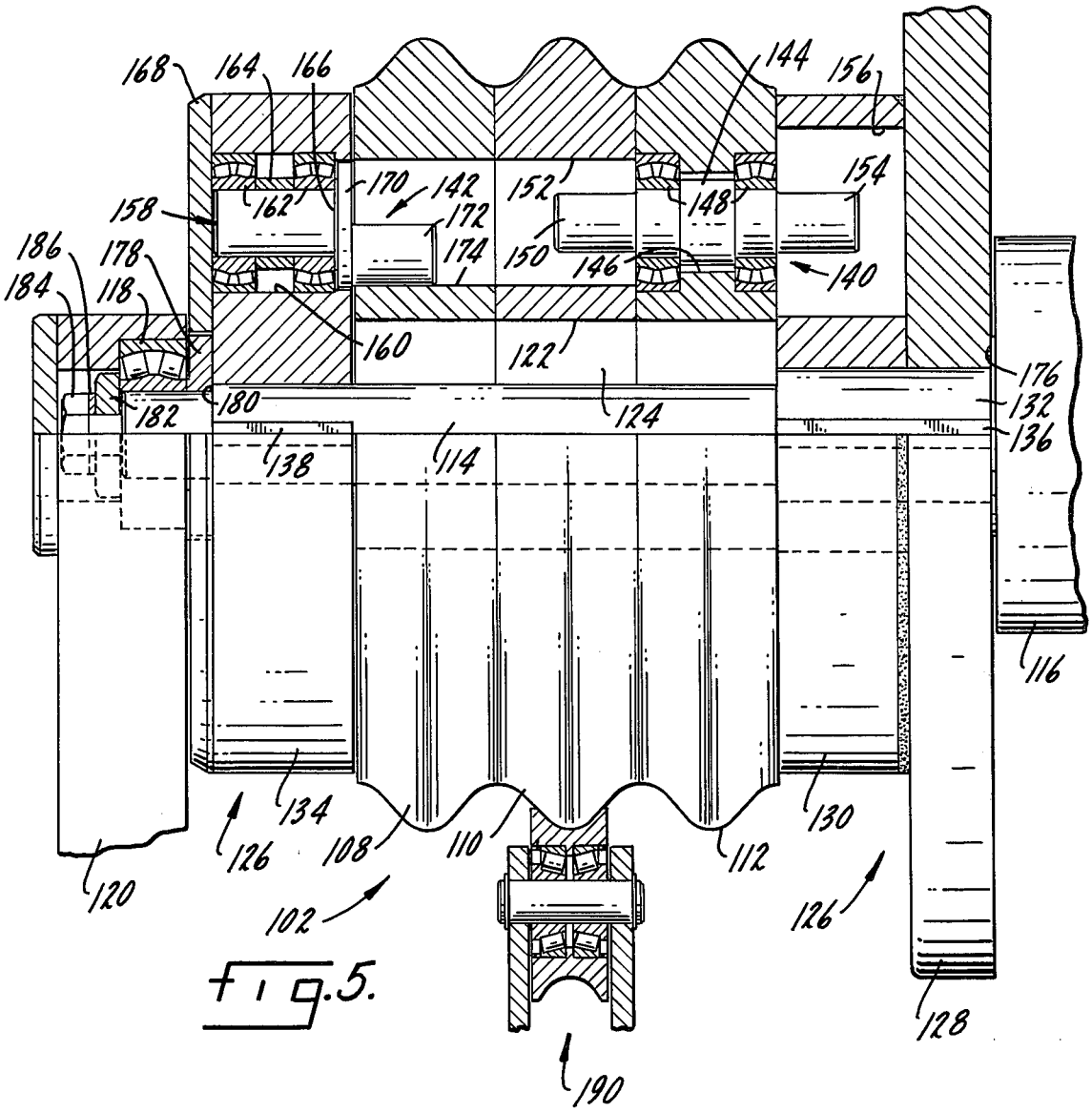
FIG. 5 is an enlarged partially sectional view of an alternative embodiment of the apparatus of FIG. 1, illustrating a modified means to interconnect the roll elements and mount them on the drive shaft.
Figure 6:
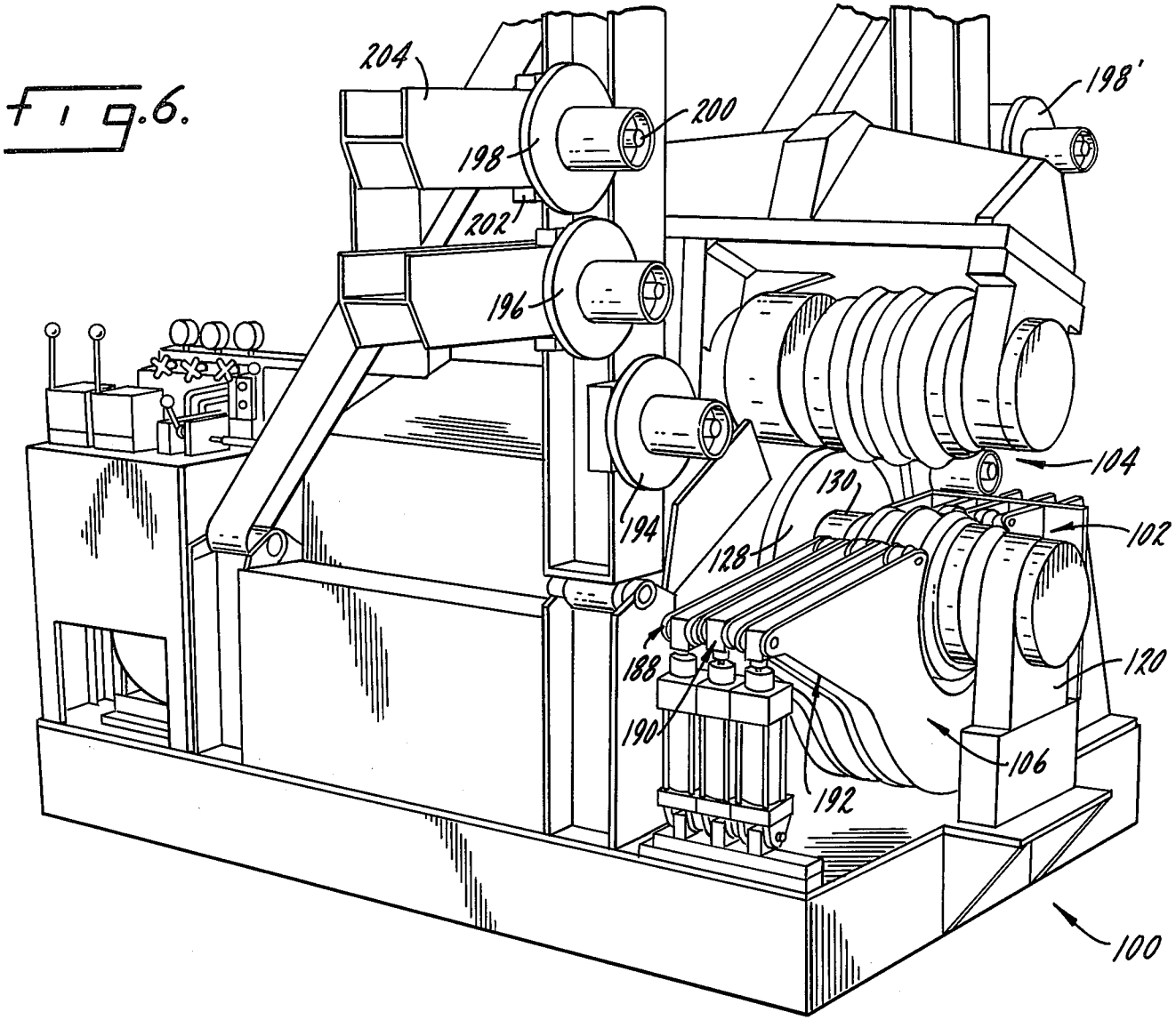
FIG. 6 is a perspective view of the mounting of the apparatus of the alternative embodiment of FIG. 5 within a recorrugator apparatus according to the invention.

The Embodiment of FIGS. 5 and 6

An alternative embodiment of the recorrugator apparatus according to the invention is generally depicted by the reference numeral 100 and comprises a composite thrust roll 102, a back-up roll 104 and a support assembly 106. The apparatus of this embodiment is similar to that previously described in FIGS. 1 through 4, excepting the elimination of one of the elements of the thrust roll, removal of its corresponding mating section of the back-up roll, and elimination of one of the hydraulically actuated lever frames.

The apparatus of FIGS. 5 and 6 is generally intended for recorrugating the end of a pipe having a deeper corrugation profile than that of a pipe recorrugated according to the apparatus of FIGS. 1 through 4. For example, the apparatus of FIGS. 1 through 4 can be employed to recorrugate spiral pipe with corrugations up to approximately ½ inch deep, while the apparatus of FIGS. 5 and 6 may be used to recorrugate spiral pipe with corrugations up to 1 inch or more in depth.

The thrust roll 102 includes a plurality of roll elements 108, 110 and 112 carried by a drive shaft 114. In the same manner as FIGS. 1 through 4, one end of the drive shaft 114 extends from a suitable prime mover 116 utilized to rotate the drive shaft. The other end of the drive shaft 114 is rotatably mounted within an anti-friction bearing assembly 118 contained within a bearing support 120 which forms part of the stationary frame of the recorrugator apparatus 100. Each of the roll elements 108, 110 and 112 is independently and individually shiftably mounted on the drive shaft 114. An inner diameter 122 of each of the roll elements is larger than the diameter of the drive shaft 114 passing therethrough, creating a normally annular space 124 which permits individual transverse movement of each of the roll elements with respect to the drive shaft 114.

A thrust roll drive mechanism of the recorrugator apparatus 100 is generally designated by the reference numeral 126. The drive mechanism is composed of a first drive plate 128 and an annular drive member 130 attached to an enlarged diameter end portion 132 of the shaft 114 formed adjacent one end of the composite thrust roll 102, and a second drive plate 134 attached to the shaft 114 adjacent the opposite end portion of the thrust roll 102. The first drive plate 128 and the annular drive member 130, which may be suitably affixed together by means such as a weld or which can be unattached, are secured for rotation with the drive shaft 114 by a key 136 drivingly engaged in a keyway formed in the enlarged diameter end portion 132 of the shaft 114 and in opposed portions of the first drive plate 128 and the annular drive member 130. Likewise, the drive plate 134 is secured for rotation with the drive shaft 114 by a key 138 which is drivingly engaged in a keyway formed in the shaft 114 and in an opposed groove within the drive plate 134.

As in the embodiment of FIGS. 1 through 4, each of the roll elements 108, 110 and 112 must be drivingly interconnected with the thrust roll driving mechanism 126. To attain this end, a pair of coupling means 140, diametrically opposed in a fashion similar to that of the coupling means 40 of the first embodiment, is provided to interconnect the annular drive member 130 of the drive mechanism 126 and the roll elements 110 and 112. To drivingly interconnect the remaining roll element 108 and the second drive plate 134, a pair of diametrically opposed coupling means 142 is provided.

Each of the coupling means 140 is identical to the coupling means 40 illustrated and described with relation to FIGS. 1 through 4. Each coupling means 140 comprises a driving pin 144 mounted within an aperture 146 formed in the roll element 112. A pair of antifriction bearings 148 anchor the driving pin 144 for rotation within the roll element 112. The driving pin 144 includes an integral axial extension 150 at one end which protrudes into an aligned circular aperture 152 in the adjacent roll element 110, and an integral axial extension 154 as its other end which extends into an aligned enlarged circular aperture 156 formed in the annular drive member 130. Each of the apertures 152 and 156 is significantly larger in diameter than the respective extensions of the drive pin 144 extending therein, allowing transverse movement of the roll elements 110 and 112 relative to the annular drive member 130. The aperture 156 is also significantly larger than the aperture 152 for reasons which will be described hereinafter. The construction and arrangement of the coupling is such that the coupling means 140 connect the roll elements 110 and 112 for positive rotational drive by the drive member 130 of the drive mechanism 126, and at the same time both of the rolls are provided with the capacity for a substantial individual transverse shifting relative to the drive shaft 114 and the drive member 130.

Each of the coupling means 142 comprises a driving pin 158 mounted within an aperture 160 formed in the second drive plate 134. A pair of antifriction bearings 162 have their inner races secured in an axially spaced relation about the central portion of the drive pin 158 and their outer races secured in an enlarged portion of the aperture 160 to accommodate rotation of the driving pin 158 within the second drive plate 134. The inner races of the antifriction bearing 162 are separated by an annular ring member 164 closely fitted about the driving pin 158. The antifriction bearing 162 is maintained on the driving in 158 by an integral enlarged collar 166 at one end of the driving pin 158 and an annular end plate 168 which abuts the second driving plate 134.

The driving pin 158 includes an integral enlarged axial end member 170 and an integral off-set extension 172 which protrudes into an aligned circular aperture 174 in the adjacent roll element 108. The aperture 174 is significantly larger in diameter than the extension 172 of the driving pin 158 extending therein, thus allowing transverse movement of the roll element 108 relative to the second drive plate 134.

As indicated above, this embodiment of the invention is specially adapted for recorrugating the ends of spirally corrugated pipe having a deeper corrugation configuration than that recorrugated by the apparatus according to the embodiment of FIGS. 1 through 4. Since, preferably, the back-up roll 104 is transversely immobile, the only separation between the back-up roll 104 and the thrust roll 102 will be the transverse movement of the roll elements 108, 110 and 112 to their lower most positions. To assure that an adequate separation between the back-up roll 104 and the thrust roll 102 can be obtained, the aperture 156 is enlarged significantly with respect to the apertures 152 and 174, and the extension 172 has been off-set in a cam fashion. Therefore, the transverse displacement of the roll elements 108, 110 and 112 will be substantially greater than that allowable by the coupling means 40 and 41 of the embodiment of FIGS. 1 through 4.

To assemble the composite thrust roll 12, the first drive plate 128 and the annular drive member 130 are secured on the enlarged portion 132 of the drive shaft 114 by the key 136, with the drive plate 128 abutting against an annular shoulder 176 of the shaft 114. Next, the roll element 112 with its pair of coupling means 140 is placed on the shaft 114 with the extensions 154 of the driving pin 144 protruding laterally into their respective apertures 156 in the annular drive member 130. The roll element 110 is then inserted on the shaft 114 with the extensions 150 of the driving pin 144 extending into their respective apertures 152 therein. The roll element 108 is then inserted on the shaft followed by the drive plate 134 carrying its pair of coupling means 142 with the off-set extension 172 extending into their respective apertures 174 in the roll element 108. The key 138 is inserted to secure the drive plate 134 to the shaft 114, and the annular end plate 168 is affixed to the face of the drive plate 134 by a plurality of screws (not illustrated). A spacer 178 is then inserted on the shaft 114 abutting an annular shoulder 180 thereof, and the antifriction bearing assembly 118 is journalled on the shaft 114, with its inner race being held against the spacer 178 by an end cap 182. A bolt 184 is threadedly secured at the end of the shaft 114, with its head bearing against a lock washer 186 to clamp the spacer 178 against the shoulder 180 through the end cap 182 and the inner race of the bearing assembly 118. The dimensions of the various parts are such that a working clearance is provided, as shown between the roll element 108 and the drive plate 34, to permit the individual transverse shifting of the roll element 108, 110 and 112 as described.

As illustrated in FIG. 6, and in precisely the same manner as that of the embodiments of FIGS. 1 through 4, each of the roll elements 108, 110 and 112 is supported by means of the support assembly 106. The support assembly includes an individual lever frame 188, 190 and 192 for each of the respective roll elements 108, 110 and 112. The lever frames are substantially identical and similar in form and operation to the lever frames 54*a* through *d* of the embodiment of FIGS. 1 through 4. A detailed description of the lever frames and their supporting hydraulic cylinders and accumulator can be obtained above.

As the end portion of a spirally corrugated pipe is recorrugated, an extremely high axial thrust is developed during the recorrugating process urging the end of the pipe against the drive plate 128. This is due to the spiral nature of the corrugations of the pipe and the resulting natural tendency of the pipe to screw into the drive plate 128 as it is rotated between the back-up roll 104 and the thrust roll 102. If the axial thrusting forces are sufficient, the pipe end will be urged against the drive plate 128 with sufficient force to deform the end of the pipe.

A helically corrugated pipe end withstands a higher axial thrust than the end of an annularly corrugated pipe of the same metal and gauge. If one were to look at the end view of a helically corrugated pipe, one would see the end as an undulating, serpentine configuration, with alternating hills and valleys about the circumference of the pipe. The end of the pipe, as it meets the drive plate 128, would do so at varying angles of contact due to the spiral nature of the corrugation. Therefore, axial thrust in some portions of the end of the pipe will be transmitted axially directly into the metal of the pipe (at the crests of the hills and valleys where the pipe wall would be perpendicular to the drive plate) and at other portions at an angle to the wall of the pipe. In contrast, an annularly corrugated pipe would meet the drive plate with its wall disposed at the same angle with respect to the drive plate. Therefore, axial thrust force would have an "accordion" effect on the pipe, and tend to flange the pipe over at its point of contact with the drive plate. To eliminate the tendency of heavier gauge and deeper corrugation pipe to be deformed as it is thrust against the drive plate 128, the roll element 18*a* of the embodiment of FIGS. 1 through 4 has been eliminated in this embodiment and replaced by the annular drive member 130. Therefore, the end portion of the pipe abutting the drive plate 128 will at all times remain in contact with the drive plate with a spiral corrugation configuration and therefore withstand higher axial thrust than a pipe end which is being recorrugated and abuts the drive plate at the same angle.

Additional support for the end portion of the pipe as it is being recorrugated by the roll elements 108, 110 and 112 is provided by a series of adjustable pipe end support members 194, 196 and 198 and their opposed complimentary pipe support members on the opposite side of the machine, of which only the member 198' is illustrated. For the sake of simplicity, only the support member 198 will be examined in detail, it being understood that the other suport members are substantially identical.

The pipe end support member 198 is mounted for rotation about a central shaft 200 by a suitable bearing means (not illustrated). The central shaft 200 is affixed to a yoke carriage 202 which is adjustably mounted upon an elongated beam 204. Due to the adjustability of the yoke carriage 202, the end portion of varying-sized diameter pipe may be accommodated by the apparatus 100 and supported by the pipe end support members 194, 196 and 198.

The operation of the apparatus is as follows:

In the same manner as described above with relation to FIGS. 1 through 4, with the roll elements 108, 110 and 112 at their lower most positions, the end portion of a pipe is inserted between the back-up roll 104 and the thrust roll 102, abutting the first drive plate 128 and, if desired, the plurality of pipe end support members 194, 196 and 198. Hydraulic fluid is then supplied to the hydraulic cylinders supporting the respective lever frames 188, 190 and 192, causing the lever frames and the roll elements 108, 110 and 112 to rise until the end portion of the pipe is matingly engaged between the thrust roll 102 and the back-up roll 104. Hydraulic fluid pressure in the accumulator is raised sufficiently for the wall of the pipe to be deformed between the rolls 102 and 104 into the serpentine longitudinal cross-sectional configuration described above, excepting the space between the roll element 112 and the drive plate 128 occupied by the annular drive member 130.

When the ultimate fluid pressure within the accumulator and the hydraulic cylinders is reached, the prime mover 116 is energized, rotating the wall of the end portion of the pipe between the rolls 102 and 104 and impressing three annular circumferential corrugations in the pipe wall. As the lock seam of the pipe enters the space between the thrust and back-up rolls, the corrugating force exerted by the hydraulic system maintains a corrugating relationship of the pipe wall between the particular roll element which engages the lock seam and the back-up roll. However, the increased thickness of the lock seam causes the particular roll element to be downwardly displaced with respect to its lever frame, compressing the hydraulic fluid within the hydraulic cylinder supporting the particular lever frame. The displaced hydraulic fluid is absorbed by the accumulator with little or no increase of pressure, therefore preventing the pressure in the remaining two hydraulic devices to be raised appreciably and thus maintaining a substantially constant and equal pressure within all three hydraulic devices. As soon as the lock seam has been traversed by the three roll elements 108, 110 and 112, the lever frames will be maintained in their upper most position and continue to corrugate between the rolls 102 and 104 the remainder of the now single thickness of the wall of the pipe end portion.

After a complete revolution of the pipe end between the rolls 102 and 104 and completion of recorrugation by the roll elements 108, 110 and 112, the pipe is moved laterally (to the left in FIG. 5) the width of one of the roll elements and commencement of impressing the fourth annular circumferential corrugation in the end portion of the pipe which was previously located between the roll element 112 and the drive plate 128 is now begun. During this recorrugation process, the pipe end does not require a drive plate or support members against which to abut, because the position of the pipe is maintained by the roll elements 108 and 110 residing in the previously recorrugated portion of the pipe.

Various changes can be made to the above-described invention without departing from the true spirit thereof or the scope of the following claims.

We claim:

1. An apparatus for forming circumferential corrugations in the end portion of a pipe where the wall of the pipe is inserted between two corrugating rolls, comprising a. a backup roll,
b. a thrust roll including a plurality of independent parallel roll elements,
c. means mounting said roll elements for independent motion transverse to one another,
d. means to engage said backup roll and said thrust roll with the wall of the end of the pipe therebetween,
e. drive means associated with said thrust roll to rotate said roll elements in unison, and
f. means to independently support each of said roll elements and retain said roll elements in contact with the end portion of the pipe so that the roll elements will form circumferential corrugations in the wall of the pipe as the pipe wall is driven between the thrust and backup rolls.

2. The apparatus according to claim 1 in which said means to support includes means to urge each roll element into contact with the wall of the pipe with a predetermined force and permit independent transverse movement of each of said roll elements when an area of abnormal thickness passes between the roll element and the backup roll, with all other roll elements maintaining full corrugating contact with the normal pipe wall thickness.

3. The apparatus according to claim 2 in which said means to support comprises a plurality of groups of support rolls, one of said groups engaging the periphery of each of the roll elements, each support roll of said groups being mounted for rotation within a pivotable lever frame.

4. The apparatus according to claim 3 in which said means to urge each roll element and permit independent transverse movement comprises a pressure-controlled hydraulic device attached to each said lever frame to retain each of said means to support in contact with its respective roll element.

5. The apparatus according to claim 1 in which said means mounting said roll elements includes a drive shaft disposed centrally within said thrust roll and an axial bore in each of said roll elements of a diameter greater than the diameter of said drive shaft.

6. The apparatus according to claim 5 wherein said drive means is fixedly attached to said drive shaft, and further including means interconnecting said drive means and said plurality of roll elements for rotation of said roll elements in unison with said drive means and drive shaft.

7. The apparatus according to claim 6 wherein said drive means includes a first drive element attached to said drive shaft adjacent one end of said plurality of roll elements and a second drive element attached to said drive shaft adjacent the other end of said plurality of roll elements.

8. The apparatus according to claim 7 wherein said first drive element includes means to abut the end of a pipe when the wall of the pipe is inserted between said backup roll and said thrust roll.

9. The apparatus according to claim 8 including a gap between said first drive element and the first of said roll elements such that as the end portion of the pipe abutting said first drive element is corrugated between said backup roll and said thrust roll, the portion of said end portion in said gap between said first drive element and the first of said roll elements remains unaltered.

10. The apparatus according to claim 7 in which said means interconnecting comprises first coupling means connecting said first drive element and at least one of said plurality of roll elements and second coupling means connecting said second drive element and the remainder of said plurality of roll elements.

11. The apparatus according to claim 10 in which said first coupling means is mounted in one of said elements and extends laterally into apertures in each adjacent other of said elements, said apertures being larger than the extension of the coupling means extending therein.

12. The apparatus according to claim 10 in which said second coupling means is mounted in one of said elements and extends laterally into apertures in each adjacent other of said elements, said apertures being larger than the extension of the coupling extending therein.

13. A multiple section roll for a corrugating apparatus comprising a drive shaft,
a plurality of independent, transversely movable roll elements mounted about said drive shaft, each of said roll elements having an axial bore of a diameter greater than the diameter of the drive shaft,
drive means adjacent said plurality of roll elements and fixedly attached to said drive shaft, and
means interconnecting said drive means and said plurality of roll elements for rotation of said roll elements in unison with said drive means and drive shaft.

14. A roll according to claim 13 in which said drive means includes at least one drive element attached to said drive shaft adjacent one end of said plurality of roll elements.

15. A roll according to claim 14 in which said means interconnecting comprises coupling means extending between said drive element and said roll elements.

16. The apparatus according to claim 15 in which said coupling means is mounted in one of said elements and extends laterally into apertures in the other of said elements, said apertures being larger than the extension of the coupling means extending therein.

17. The apparatus according to claim 16 including a drive element attached to said drive shaft adjacent each end of said plurality of roll elements.

* * * * *